US007095294B2

(12) United States Patent
Fojas

(10) Patent No.: US 7,095,294 B2
(45) Date of Patent: Aug. 22, 2006

(54) DIRECTIONAL BRIDGE COUPLER

(75) Inventor: Uriel C. Fojas, Santa Rosa, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 190 days.

(21) Appl. No.: 10/882,017

(22) Filed: Jun. 30, 2004

(65) Prior Publication Data

US 2006/0001505 A1 Jan. 5, 2006

(51) Int. Cl.
*H01P 5/10* (2006.01)
*H01P 5/103* (2006.01)

(52) U.S. Cl. ..... 333/112; 333/26; 333/109

(58) Field of Classification Search ..... 333/26, 333/109, 112
See application file for complete search history.

(56) References Cited

U.S. PATENT DOCUMENTS 3,883,823 A * 5/1975 Grace ..... 331/107 C
6,084,485 A * 7/2000 Bickford et al. ..... 333/26
6,741,070 B1 * 5/2004 Kodato ..... 324/95

* cited by examiner

*Primary Examiner*—Dean Takaoka
(74) *Attorney, Agent, or Firm*—John L. Imperato

(57) ABSTRACT

A directional bridge coupler includes a coaxial balun having a coaxial cable with a plurality of ferrite beads disposed about an outer conductor of the coaxial cable, and a circuit substrate accommodating a directional bridge coupled to an output of the coaxial bridge. A conductive package having an internal cavity houses the circuit substrate and the coaxial balun. A polyiron saddle straddles a portion of the coaxial balun within the internal cavity of the conductive package.

20 Claims, 4 Drawing Sheets

DIRECTIONAL BRIDGE COUPLER

BACKGROUND OF THE INVENTION

Couplers play an important role in network measurement systems. In addition to providing connections between a network measurement system and a device under test (DUT), couplers provide the important function of separating incident and reflected waves for network measurements. A measure of this separation between incident and reflected waves, referred to as directivity, influences the measurement accuracy of the network measurement system. Higher directivity generally increases measurement accuracy. Directivity is an especially important performance measure of a coupler when measuring DUTs that have impedance-matched ports and attenuation losses that result in reflected waves that have low magnitudes.

One known type of coupler, shown in the schematic diagram of FIG. 1, is a directional bridge. The directional bridge is commonly used in network measurement systems, such as scalar and vector network analyzers. While the directional bridge provides excellent low frequency performance, important performance parameters of the directional bridge such as directivity, coupling, insertion loss, and isolation, degrade above approximately nine gigahertz, as shown in the response plot of FIG. 2. Thus, the directional bridge, which has excellent performance at low operating frequencies, has poor performance at high operating frequencies.

In contrast to the directional bridge, wherein various signal paths have physical connections to each other, a proximity coupler includes coupled transmission lines that are physically separated. Physical separation between the coupled transmission lines causes this type of coupler to have a low-frequency operating limit of approximately ten megahertz. While proximity couplers generally have poor performance at low frequencies, proximity couplers can be designed to have high-frequency operating limits that exceed twenty gigahertz.

In many types of network measurement systems, there is a need for couplers that have high directivity and relatively flat coupling over a wide frequency range. For example, a network analyzer may have an operating frequency range that spans from several hundred kilohertz at the lower operating frequency limit, to twenty gigahertz at the upper operating frequency limit. To achieve such a wide operating frequency range, commercially available network measurement systems typically use a proximity coupler and a directional bridge connected in a parallel, switched arrangement, wherein a switch selects between the two different types of couplers according to the operating frequency of the network measurement system. However, this switched arrangement is cumbersome since it requires the two couplers, the switch, and a control signal to set the position of the switch. The switch also has the disadvantage of introducing power losses at the test ports of the network measurement system, which can reduce the measurement sensitivity of the network measurement system within which the switched coupler arrangement is included.

SUMMARY OF THE INVENTION

A directional bridge coupler according to embodiments of the present invention provides a low frequency operating limit comparable to that of a directional bridge, and a high frequency operating limit comparable to that of a proximity coupler. The directional bridge coupler has an operating frequency range that is wide enough to accommodate a broadband network measurement system.

DETAILED DESCRIPTION OF THE EMBODIMENTS

Figure 2:
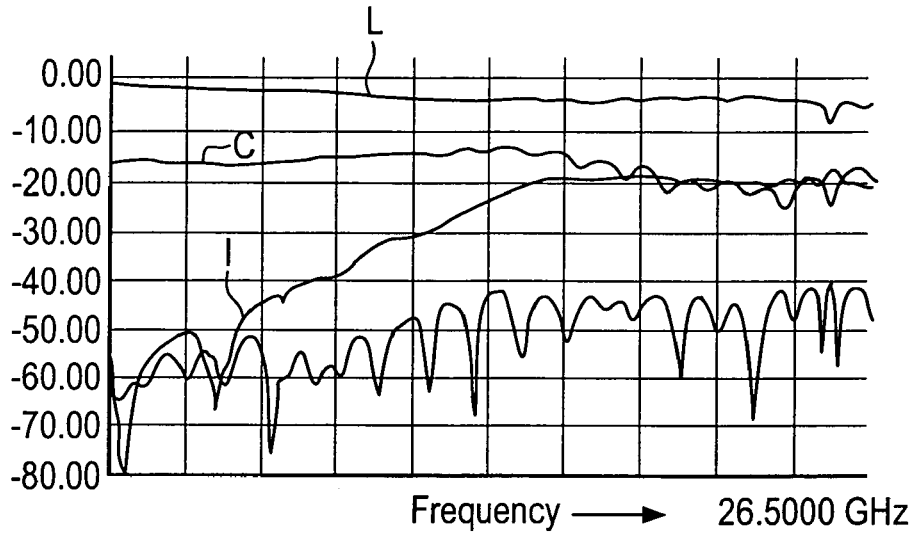
Figure 2 (Prior Art)
FIG. 2 shows a response plot associated with a prior art implementation of the directional bridge.
Figure 3:
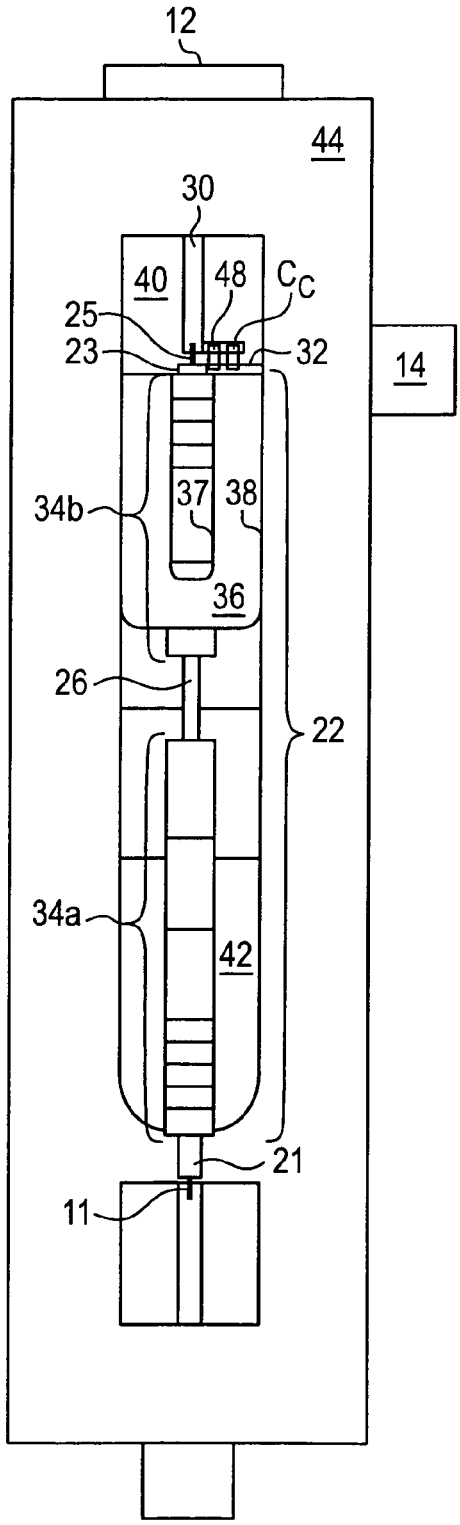
FIG. 3 shows a directional bridge coupler according to the embodiments of the present invention.

A directional bridge coupler 20 according to the embodiments of the present invention is shown in FIG. 3. The directional bridge coupler 20 is based on the schematic diagram of a directional bridge 10 shown in FIG. 1. One commercial implementation of a directional bridge 10 is included in the model N338xA series Performance Vector Network Analyzer, from AGILENT TECHNOLOGIES, INC., Palo Alto, Calif., USA. This prior art implementation of the directional bridge has an associated performance indicated in the response plot of FIG. 2. In this response plot, isolation I between designated ports in this implementation of the directional bridge 10 steadily degrades at frequencies above approximately 5 GHz. Directivity D, an important performance parameter of the directional bridge 10 that depends on the isolation I, insertion loss L, and coupling C, correspondingly degrades at frequencies above 5 GHz.

This degraded performance at higher operating frequencies renders this prior art implementation of the directional bridge 10 not well-suited for use above approximately 9 GHz. When expressed in decibels, the directivity D can be expressed according to the relationship $D=I-(L+C)$.

Figure 1:
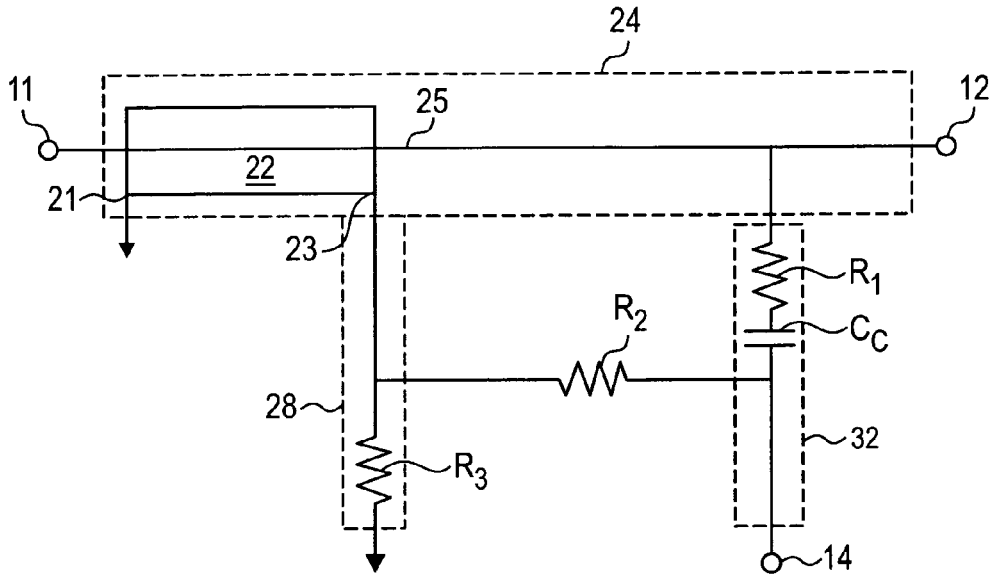
Figure 1 (Prior Art)
FIG. 1 shows a schematic diagram of a directional bridge.

The directional bridge coupler 20 according to the embodiments of the present invention shown in FIG. 3 is an alternative implementation of the directional bridge 10 (shown in FIG. 1). The directional bridge coupler 20 includes a coaxial balun 22 at the input of a through arm 24 (shown in FIG. 1) of the directional bridge coupler 20, cascaded with a circuit substrate 40 accommodating the components of the directional bridge 10, such as the resistors R1, R2, R3 and capacitor $C_c$, as depicted in FIG. 1. The coaxial balun 22 includes a coaxial cable 26 throughout its length. In one example, the coaxial cable 26 is a semi-rigid transmission line having an outer conductor with an outer diameter of 0.047" and having an inner conductor with a diameter of 0.0113". The outer conductor of the coaxial cable 26 is grounded at a first end 21 proximate to the input 11 of the coaxial balun 22. At a second end 23, or output, of the coaxial cable 26, the outer conductor is connected to a shunt input arm 28 (shown in FIG. 1) of the directional bridge 10, accommodated on the circuit substrate 40. The center conductor 25 of the coaxial cable 26 protrudes from the second end 23 of the coaxial balun 22 and is connected to the through arm 24 of the directional bridge 10 accommodated on the circuit substrate 40. A through output 30 of the circuit substrate 40 provides the output 12 of the directional bridge coupler 20, whereas a shunt output arm 32 of the circuit substrate 40 provides the output at the coupled port 14 of the directional bridge coupler 20.

The coaxial balun 22 also includes a plurality of ferrite beads 34*a*, 34*b* disposed about the outer conductor of the coaxial cable 26. The ferrite beads 34*a*, 34*b* have cylindrical cross-sections and a cylindrical central lumen of sufficiently large diameter to accommodate the outer conductor of the coaxial cable 26. In the example where the coaxial cable 26 has an outer diameter of 0.047", the cylindrical central lumen has a nominal diameter of 0.051" to accommodate the outer conductor of the coaxial cable 26. With the ferrite beads 34*a*, 34*b* positioned on the coaxial cable 26, the surfaces of the cylindrical central lumens are in contact with the outer conductor of the coaxial cable 26, or in close proximity to the outer conductor of the coaxial cable 26.

In one example, the plurality of ferrite beads includes two series of ferrite beads 34*a*, 34*b* disposed about the outer conductor of the coaxial cable 26. The first series 34*a* of ferrite beads provides low frequency loading on the coaxial balun 22 and is positioned on the coaxial cable 26 proximate to the first end 21. The ferrite bead in the first series 34*a* are formed from a combination of manganese and zinc. The second series 34*b* of ferrite beads, cascaded with the first series 34*a* of ferrite beads along the coaxial cable 26, provides high frequency loading on the coaxial balun 22. The second series 34*b* of ferrite beads is positioned on the coaxial cable 26 proximate to the second end 23 and is formed from a combination of nickel and zinc. The ferrite beads 34*a*, 34*b* are commercially available from manufacturers such as FERRONICS INCORPORATED, located in Fairport, N.Y., USA.

The directional bridge coupler 20 also includes a polyiron saddle 36 that straddles a portion of the second series 34*b* of ferrite beads proximate to the second end 23 of the coaxial cable 26. The polyiron saddle 36 is typically constructed with ferrous particles embedded in a plastic insulating binder. An exemplary ratio of ferrous particles to plastic particles is four to one by mass, although other ratios are suitable for use in the polyiron saddle 36.

The polyiron saddle 36 has an access aperture 37 to provide a probe or other tuning tool (not shown) access to enable manipulation of the position of the ferrite beads 34*b*. The access aperture 37 enables the second series 34*b* of ferrite beads to be displaced along the axis of the coaxial cable 26 to tune the performance response of the directional bridge coupler 20. In tuning the directional bridge coupler 20, isolation I, insertion loss L and coupling C responses are typically observed as the ferrite beads are displaced along the axis of the coaxial cable 26. When the positions of the ferrite beads 34*a*, 34*b* are established based on tuning or other criteria, the position of the ferrite beads can be fixed, typically with epoxy or other adhesive. In the example shown, the second series 34*b* of ferrite beads includes two ferrite beads of length 0.256" along the axis of the coaxial cable 26 cascaded with four ferrite beads of length 0.064" along the axis of the coaxial cable 26. The four ferrite beads of shorter length provide sufficient sensitivity for tuning performance parameters such as isolation I, insertion loss L, and coupling C.

Outer portions of the polyiron saddle 36 contact inner walls 38 of a cavity 42 in a conductive package 44 that houses the directional bridge coupler 20. Slight displacements of the polyiron saddle 36 along the axis of the coaxial cable 26 can also be made to adjust the performance response of the directional bridge coupler 20. Once the position of the polyiron saddle 36 is established based on response plots of isolation I, insertion loss L, coupling C, or other criteria, the position of the polyiron saddle 36 can be fixed in the cavity 42, typically with epoxy or other adhesives.

Figure 4:
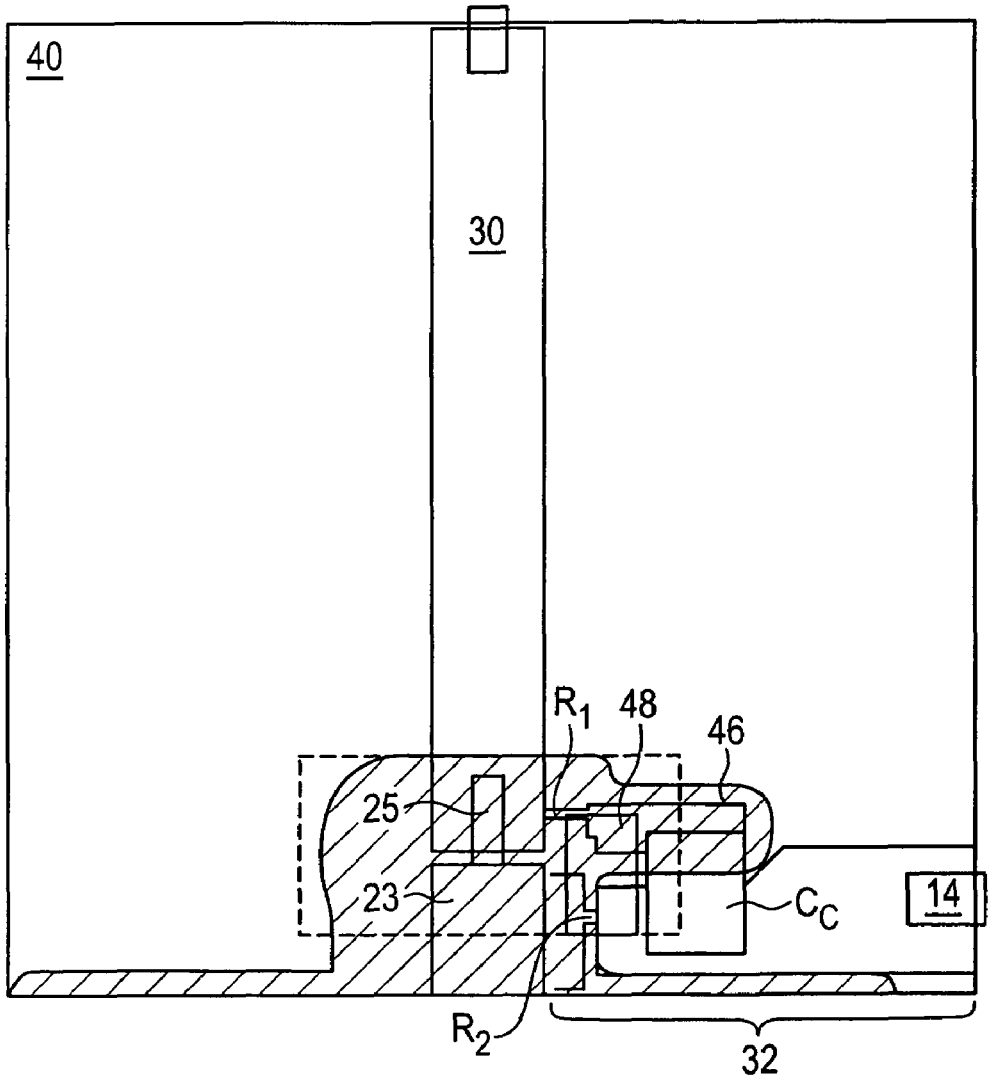
FIG. 4 shows a detailed view of the directional bridge coupler shown in FIG. 3.

The conductive package 44 includes a relief 46 below the circuit substrate 40 as shown in the detailed view of FIG. 4. The relief 46 below the circuit substrate 40 has a depth substantially thicker than the thickness of the circuit substrate 40. In one example, the circuit substrate is 0.010" thick and the relief 46 below the circuit substrate 40 is greater than 0.10" deep. In another example, the relief 46 below the circuit substrate 40 extends below the capacitor $C^c$ on the circuit substrate 40 under a conductive path in the shunt output arm 32 that provides the output at the coupled port 14 of the directional bridge coupler 20.

In alternative embodiments of the present invention, one or more polyiron tuning blocks are included on a top-side of the circuit substrate 40. In one example, a polyiron block 48 is positioned in the conductive path in the shunt output arm 32 between the center conductor 25 at the second end 23 of the coaxial cable 26 and the capacitor $C_c$. However, other types of lossy elements that provide signal attenuation are alternatively included in the shunt output arm 32 between the center conductor 25 at the second end 23 of the coaxial cable 26 and the capacitor $C_c$.

Figure 5:
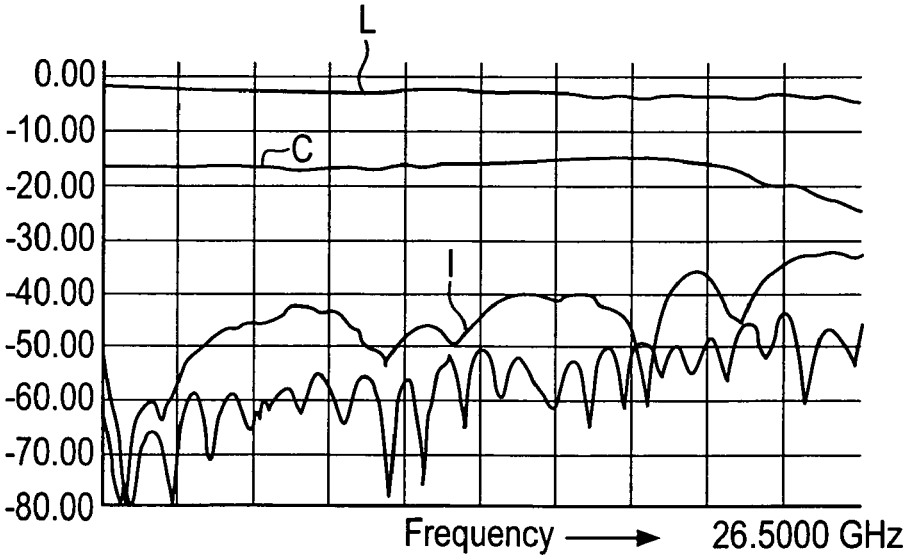
FIG. 5 shows a response plot of a directional bridge coupler according to the embodiments of the present invention.

FIG. 5 shows a performance plot of the directional bridge coupler 20, indicating the isolation I, insertion loss L and the coupling C versus frequency. Relative to the prior art implementation of the directional bridge 10 that has the associated response plot of FIG. 2, the directional bridge coupler 20 according to the embodiments of the present invention has improved isolation I, resulting in higher directivity D for the directional bridge coupler 20. This high directivity D of the directional bridge coupler 20 renders the directional bridge coupler 20 suitable for use at frequencies as high as 20 GHz. While having a high-frequency operating limit of at least 20 GHz, the directional bridge coupler has a low-frequency operating limit of 300 KHz, which makes the directional bridge coupler 20 well-suited for use with broadband network measurement systems such as scalar and vector network analyzers.

While the embodiments of the present invention have been illustrated in detail, it should be apparent that modifications and adaptations to these embodiments may occur to one skilled in the art without departing from the scope of the present invention as set forth in the following claims.

What is claimed is:

1. A directional bridge coupler, comprising:

a coaxial balun including a coaxial cable with a plurality of ferrite beads disposed about an outer conductor of the coaxial cable;

a circuit substrate accommodating a directional bridge coupled to an output of the coaxial cable;

a conductive package having an internal cavity housing the circuit substrate and the coaxial balun;

a polyiron saddle straddling a portion of the coaxial balun within the internal cavity of the conductive package.

2. The directional bridge coupler of claim 1 wherein the polyiron saddle has an access aperture that enables displacement of ferrite beads within the portion of the coaxial balun straddled by the polyiron saddle along the coaxial cable.

3. The directional bridge coupler of claim 1 wherein the plurality of ferrite beads includes a series of low frequency ferrite beads cascaded with a series of high frequency ferrite beads, the polyiron saddle straddling the portion of the coaxial balun that includes the series of high frequency beads.

4. The directional bridge coupler of claim 3 wherein the polyiron saddle has an access aperture that enables displacement of ferrite beads within the series of high frequency ferrite beads along the coaxial cable.

5. The directional bridge coupler of claim 1 further comprising at least one polyiron block positioned in a shunt output arm of the directional bridge between the output of the coaxial cable and a coupled port of the directional bridge coupler.

6. The directional bridge coupler of claim 2 further comprising at least one polyiron block positioned in a shunt output arm of the directional bridge between the output of the coaxial cable and a coupled port of the directional bridge coupler.

7. The directional bridge coupler of claim 3 further comprising at least one polyiron block positioned in a shunt output arm of the directional bridge between the output of the coaxial cable and a coupled port of the directional bridge coupler.

8. The directional bridge coupler of claim 4 further comprising at least one polyiron block positioned in a shunt output arm of the directional bridge between the output of the coaxial cable and a coupled port of the directional bridge coupler.

9. The directional bridge coupler of claim 1 wherein the conductive package has a relief below the circuit substrate under a shunt output arm of the directional bridge between the output of the coaxial cable and a coupled port of the directional bridge coupler.

10. The directional bridge coupler of claim 2 wherein the conductive package has a relief below the circuit substrate under a shunt output arm of the directional bridge between the output of the coaxial cable and a coupled port of the directional bridge coupler.

11. The directional bridge coupler of claim 3 wherein the conductive package has a relief below the circuit substrate under a shunt output arm of the directional bridge between the output of the coaxial cable and a coupled port of the directional bridge coupler.

12. The directional bridge coupler of claim 4 wherein the conductive package has a relief below the circuit substrate under a shunt output arm of the directional bridge between the output of the coaxial cable and a coupled port of the directional bridge coupler.

13. The directional bridge coupler of claim 5 wherein the conductive package has a relief below the circuit substrate under a shunt output arm of the directional bridge between the output of the coaxial cable and a coupled port of the directional bridge coupler.

14. The directional bridge coupler of claim 6 wherein the conductive package has a relief below the circuit substrate under a shunt output arm of the directional bridge between the output of the coaxial cable and a coupled port of the directional bridge coupler.

15. The directional bridge coupler of claim 9 wherein the relief is deeper than the thickness of the circuit substrate accommodating the directional bridge.

16. The directional bridge coupler of claim 10 wherein the relief is deeper than the thickness of the circuit substrate accommodating the directional bridge.

17. The directional bridge coupler of claim 11 wherein the relief is deeper than the thickness of the circuit substrate accommodating the directional bridge.

18. The directional bridge coupler of claim 12 wherein the relief is deeper than the thickness of the circuit substrate accommodating the directional bridge.

19. The directional bridge coupler of claim 13 wherein the relief is deeper than the thickness of the circuit substrate accommodating the directional bridge.

20. The directional bridge coupler of claim 14 wherein the relief is deeper than the thickness of the circuit substrate accommodating the directional bridge.

* * * * *